US006172655B1

(12) United States Patent
Volman

(10) Patent No.: US 6,172,655 B1
(45) **Date of Patent: *Jan. 9, 2001**

(54) ULTRA-SHORT HELICAL ANTENNA AND ARRAY THEREOF

(75) Inventor: Vladimir Volman, Newtown, PA (US)

(73) Assignee: Lockheed Martin Corporation, Sunnyvale, CA (US)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/249,678

(22) Filed: Feb. 12, 1999

(51) Int. Cl.[7] ..... H01Q 1/36
(52) U.S. Cl. ..... 343/895
(58) Field of Search ..... 343/895, 893; H01Q 1/36

(56) References Cited

U.S. PATENT DOCUMENTS

| | | | | |
|---|---|---|---|---|
| 4,163,981 | * | 8/1979 | Wilson | 343/895 |
| 4,169,267 | | 9/1979 | Wong et al. | 343/895 |
| 4,489,276 | * | 12/1984 | Yu | 343/895 |
| 4,742,359 | * | 5/1988 | Ishino et al. | 343/895 |
| 5,258,771 | | 11/1993 | Praba | 343/895 |
| 5,612,704 | * | 3/1997 | Cole | 343/895 |
| 5,914,689 | * | 6/1999 | Cockson | 343/895 |
| 6,016,130 | * | 1/2000 | Annamaa | 343/895 |

* cited by examiner

*Primary Examiner*—Hoanganh Le
(74) *Attorney, Agent, or Firm*—W. H. Meise

(57) ABSTRACT

A short axial-mode helical antenna (10) includes a winding (12) including a conductor (20) helically wound about an axis (8). A first portion (22) of the winding is wound with a first pitch ($\alpha$) on a segment of a cone (41) having a smaller diameter (D1) at a plane (31) adjacent a ground plane (14), and a larger diameter (D2) at a second plane (32) parallel with the ground plane and remote therefrom. A second portion (24) of the winding (12) is wound with a second pitch ($\beta$) on a segment of a second cone (42) coaxial with the first cone, and having its smaller diameter (D3) at a third plane (33) parallel with the first and second planes. The antenna provides higher gain than a straight uniform, tapered-end, continuous taped, or nonuniform-diameter helical antenna of equal length, and consequently has less mutual coupling when mounted in an array.

7 Claims, 8 Drawing Sheets

600
14
616
616c
626
631
628
608
620
632
641
641c
642
642c
633
630
α
β
16
16c
26
28
8
20
41
41c
42
42c
30
33
12
32
31
24
22
D2
D3
D1

ULTRA-SHORT HELICAL ANTENNA AND ARRAY THEREOF

FIELD OF THE INVENTION

This invention relates to antennas, and more particularly to helical-type antennas and arrays thereof.

BACKGROUND OF THE INVENTION

High gain antennas are widely used for communication purposes and for radar or other sensing use. In general, high antenna gains are associated with high directivity, which in turn arises from a large radiating aperture. A common method for achieving a large radiating aperture is by the use of parabolic reflectors fed by a feed arrangement located at the focus of the parabolic reflector. Parabolic reflector type antennas can be very effective, but for certain purposes may present too much of a wind load, and for scanning use may have too much inertia to achieve the desired scanning acceleration. Also, reflector antennas in general suffer from the problem of aperture blockage attributable to the support structure required to support the feed antenna, and the feed antenna itself, which may adversely affect the field distribution over the surface of the reflector, and thereby perturb the far-field radiation pattern.

Those skilled in the art know that antennas are reciprocal transducers, which exhibit similar properties in both transmission and reception modes of operation. For example, the antenna patterns for both transmission and reception are identical, and exhibit the same gain. For convenience of explanation, explanations and descriptions of antenna performance are often couched in terms of either transmission or reception, with the other mode of operation being understood therefrom. Thus, the terms "aperture illumination," "beam" or "radiation pattern" may pertain to either a transmission or reception mode of operation. For historical reasons, the antenna port or electrical connections are known as "feed" port or connections, even though the same port is used for both transmission and reception, and the term "beam" may apply to the entire radiation pattern or to a single lobe thereof.

Modern communication and sensing systems find increasing use for antenna arrays for high-gain use. An antenna array includes an array or battery of usually-identical antennas or elements, each of which ordinarily has lower gain than the array antenna as a whole. The arrayed antenna elements are fed with an amplitude and phase distribution which establishes the far-field "radiation" pattern or beam. Since the phase and power applied to each antenna element of an array antenna can be individually controlled, the direction and characteristics of the beam can be controlled by control of the distribution of power (signal amplitude or gain) and phase over the antenna aperture. A salient advantage of an array antenna is the ability to scan the beam or beams electronically, without physically moving the mass of a reflector, or for that matter any mass whatever.

Many problems attend the use of array antennas. While a reflector is not necessary (although one may be used, if desired), achieving high gain still requires a large effective radiating aperture. The far-field radiation pattern of an array antenna is the product of the radiation pattern of one of the antenna elements, multiplied by the radiation pattern of a corresponding array of isotropic sources (sources which radiate uniformly in all directions), or in other words the product of the radiation pattern of an individual antenna element multiplied by the array factor. Thus, achieving high gain in an array antenna may require an array factor giving high gain, an individual antenna element having high gain, or both. The array factor can be increased to a certain extent by increasing the distance between individual element, but when the inter-element spacing becomes large, grating lobes may degrade the desired radiation pattern. Thus, achieving high gain in an array antenna may depend upon use of high-gain antenna elements.

Those skilled in the art also know that one of the salient characteristics of an antenna is its field polarization. There are two general classes of field polarization, one of which is linear, and the other of which is circular. In the case of linear polarization, the electric field vector of the radiated beam appears, at a given location far from the antenna, as a line, which may be oriented in any desired direction, as for example vertically or horizontally. In the case of circular polarization, on the other hand, the electric field vector rotates in a plane orthogonal to the direction of propagation at a rate related to the frequency of the propagating wave. It should be noted that the term "circular" polarization refers to a theoretical condition which is approached only on rare occasions, and the term "circular" is often applied to imperfect circular polarization which would more properly be termed "elliptical".

When circular polarization is desired in the context of an array antenna, a circularly polarized antenna element is often used. U.S. Pat. No. 5,258,771, issued Nov. 2, 1993 in the name of Praba, describes an array antenna in which circular polarization is achieved by the use of axial-mode helical antennas. In the Praba arrangement, the axial mode helical antenna elements themselves have relatively high gain. In order to reduce mutual coupling between some of the antenna elements, which tends to reduce the effective gain of the antenna elements and makes analysis difficult, the spacing between elements is maximized. For one of the arrays described in the Praba patent, the interelement spacing is one wavelength ($\lambda$) or more. The grating lobes which result from this situation are suppressed by adjusting the individual antenna elements to null the grating lobes.

In many applications, such as for spacecraft or aircraft, small volume and light weight of an antenna array are extremely important.

SUMMARY OF THE INVENTION

An antenna winding according to an aspect of the invention includes an elongated electrical conductor. The elongated electrical conductor includes a feed end, and a distal end remote from the feed end. The elongated electrical conductor is wound in a generally helical fashion about an axis to define first and second portions of the antenna winding. The first portion of the antenna winding has a first diameter adjacent the feed end of the electrical conductor, and a second diameter, different from the first diameter, at an end of the first portion remote from the feed end. This first portion of the antenna winding is wound with a first pitch angle. Since the electrical conductor is continuous, the second portion of the antenna winding is immediately adjacent the first portion of the antenna winding, so the second portion of the antenna winding has the same second diameter at an end of the second portion which is adjacent the first portion, or remote from the distal end of the electrical conductor. The second portion of the antenna winding has a third diameter, different from the second diameter, adjacent the distal end of the electrical conductor. The second portion of the antenna winding being is wound with a second pitch angle, different than the first pitch angle. The second diameter, which is the diameter at the juncture of the first and second portions of the helical antenna, is either greater than the first and third diameters or less than the first and third diameters. In other words, the second diameter is one of greater than and less than the first and third diameters.

In a particularly advantageous embodiment of the invention, the first and second portions of the antenna are each wound with constant pitch. In this embodiment, the elongated electrical conductor of (or in) the first portion of the antenna winding is wound on the surface of a section of a hypothetical cone having the first and second diameters. In this embodiment, the elongated electrical conductor in said second portion of the antenna winding is wound on the surface of a section of a hypothetical cone having the second and third diameters. The second diameter is larger than the first and third diameters.

According to another aspect of the invention, an antenna includes an antenna winding with an elongated electrical conductor including a feed end and a distal end remote from the feed end. The elongated electrical conductor is wound in a generally helical fashion about an axis to define first and second portions of the antenna winding. The first portion of the antenna winding has a first diameter adjacent the feed end of the electrical conductor, and a second diameter, different from the first diameter, at an end of the first portion remote from the feed end. The first portion of the antenna winding is wound with a first pitch angle. The second portion of the antenna winding has the second diameter at an end of the second portion remote from the distal end of the electrical conductor, and a third diameter, different from the second diameter, adjacent the distal end of the electrical conductor. The second portion of the antenna winding is wound with a second pitch angle, which is different than the first pitch angle. The second diameter is greater than both the first and third diameters, or less than both the first and third diameters, or in other words the second diameter is one of greater than and less than the first and third diameters. The antenna includes an electrically conductive ground plane is oriented orthogonal to the axis about which the first winding is wound, and which is located adjacent the feed end of the elongated electrical conductor. A feed is coupled to the ground plane and to the feed end of the elongated electrical conductor, for coupling electromagnetic energy to and from the antenna. In a preferred embodiment of this antenna, the feed is a coaxial feed. This antenna further includes a second antenna winding different from the first antenna winding. The second antenna winding includes a second elongated electrical conductor including a feed end and a distal end remote from the feed end, as in the case of the first-mentioned electrical conductor. The second elongated electrical conductor is wound in a generally helical fashion about a second axis, different from, but parallel to, the first-mentioned axis, to define first and second portions of the second antenna winding. The first portion of the second antenna winding has the first diameter adjacent the feed end of the second elongated electrical conductor, and the second diameter at an end of the first portion of the second antenna winding remote from the feed end of the second elongated electrical conductor. The first portion of the second antenna winding is wound with the first pitch angle. The second portion of the second antenna winding has the second diameter at an end of the second portion of the second antenna winding remote from the distal end of the second elongated electrical conductor, and the third diameter adjacent the distal end of the second elongated electrical conductor. The second portion of the second antenna winding is wound with the second pitch angle. The second diameter of the second portion of the second antenna winding is the one of greater than and less than the first and third diameters. A second feed is coupled to the ground plane at a location different from the location of the first-mentioned feed. The second antenna winding is located with the feed end of the second elongated electrical conductor electrically connected to the second feed, to thereby define an array antenna including the first and second antenna windings and the first and second feeds.

BRIEF OF DESCRIPTION OF THE DRAWING

FIG. 1*a* is a simplified perspective or isometric view of an antenna including an antenna winding, together with a ground plane and feed, and FIG. 1*b* is an elevation view of the antenna of FIG. 1*a;*

DESCRIPTION OF THE INVENTION

Figure 1A:
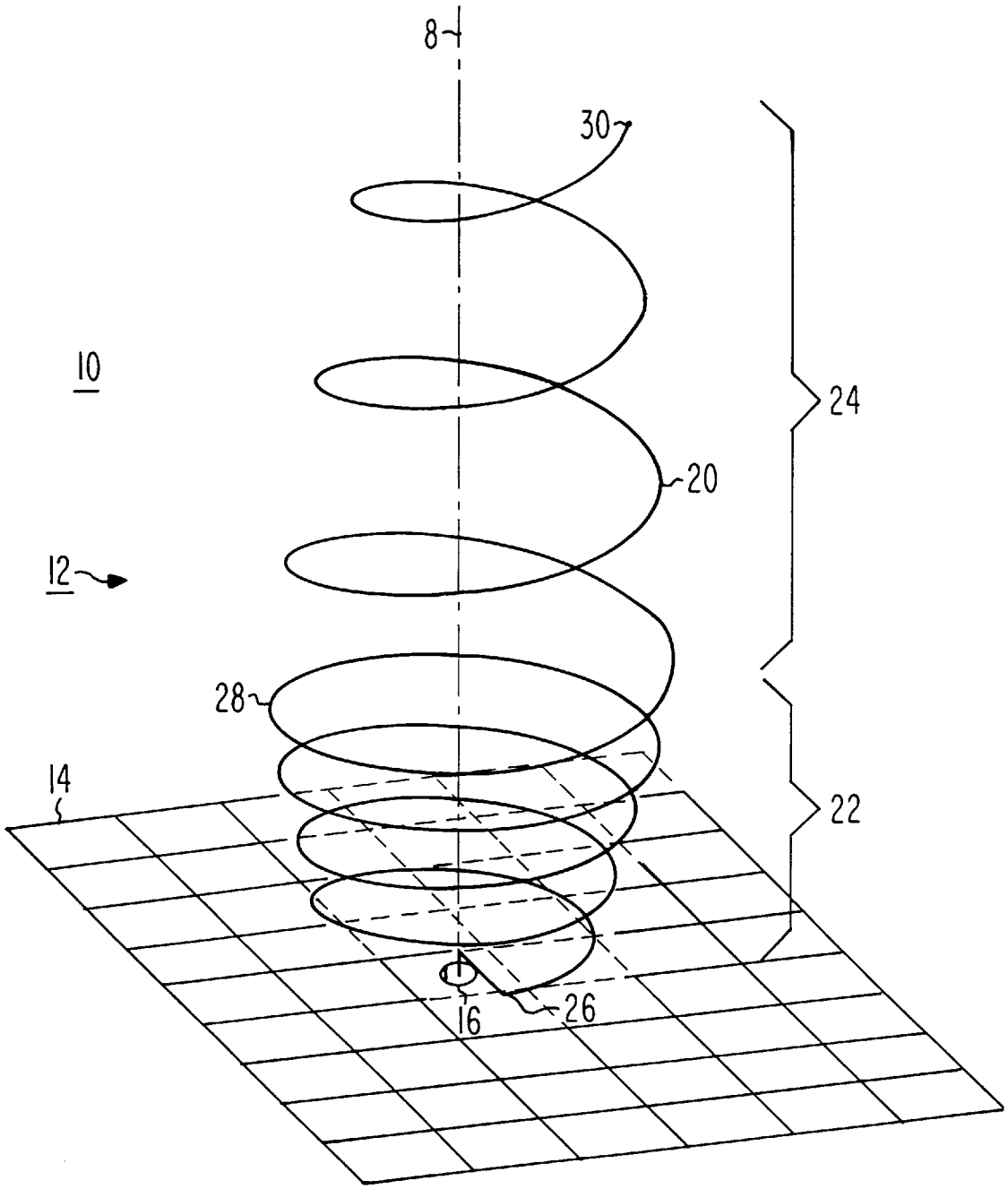
Figure 1B:
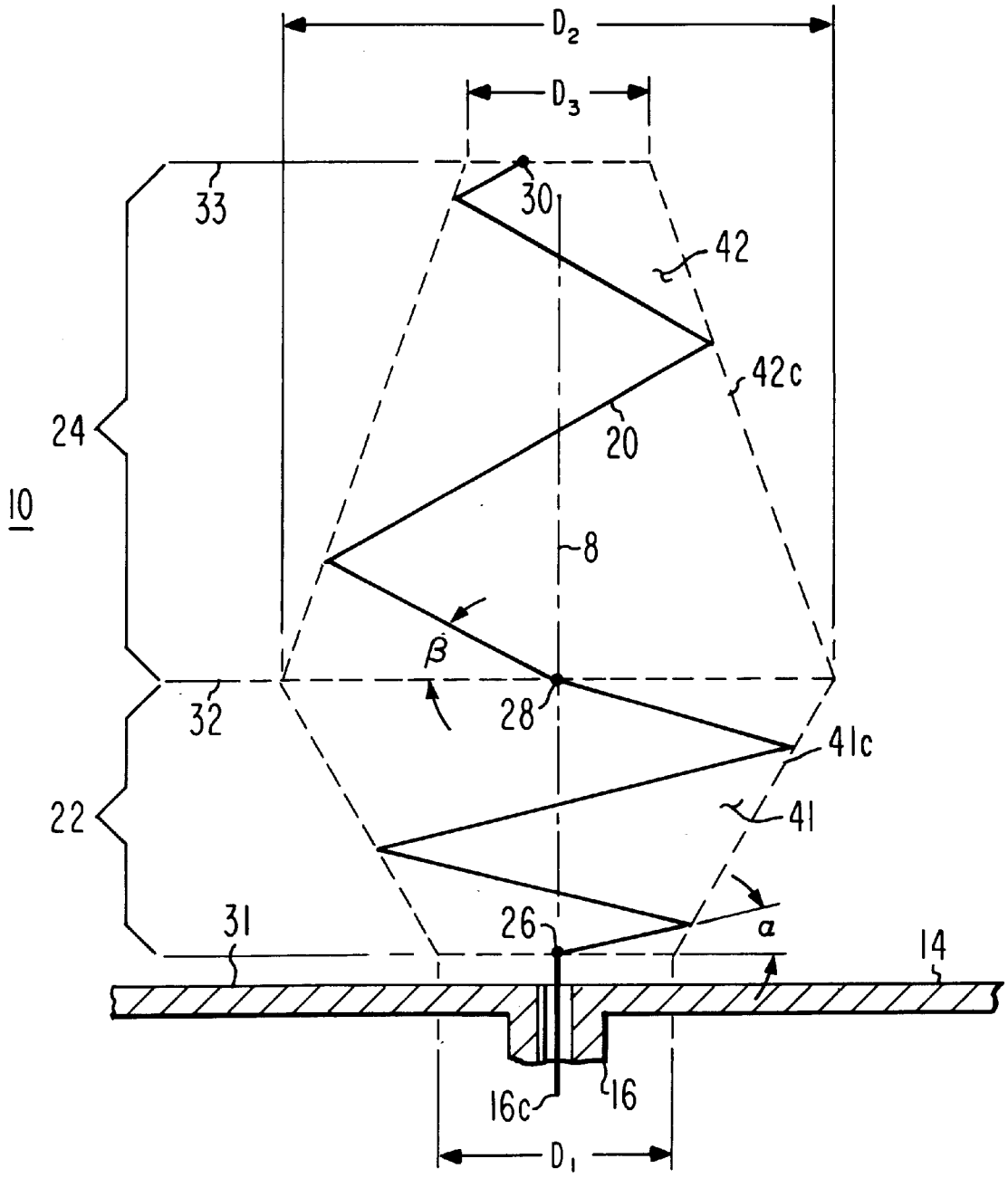

In FIGS. 1*a* and 1*b*, an antenna 10 includes a winding 12, a ground plane 14, and a coaxial feed 16. As illustrated, winding 12 includes an electrical conductor 20 helically wound about an axis 8, which is orthogonal (at right angles) to ground plane 14. Conductor 20 may be in the form of a wire, a ribbon, or the like. Conductor 20 defines a feed end 26 which is located adjacent ground plane 14, and a second or remote end 30 which is remote from ground plane 14.

Antenna winding 12 of FIGS. 1*a* and 1*b* includes a first portion designated 22 and a second portion designated 24. Since conductor 20 is one continuous piece, portions 22 and 24 of antenna winding 12 are immediately adjacent to each other, and connect at a location 28. In first portion 22 of antenna winding 12, the conductor 20 is wound with a pitch angle $\alpha$ relative to a plane 31, which is parallel to the upper surface of ground plane 14. In second portion 24, conductor 20 is wound with a pitch angle $\beta$ relative to a plane 32, which is parallel with plane 31 and includes location 28. The conductor 20 of winding 12 in first portion 22 extends from location 26 on plane 31 to location 28 on plane 32, so planes 31 and 32 may be viewed as defining the extent of the first portion 22 of antenna winding 12. The conductor 20 of winding 12 in the second portion 24 of winding 12 extends from location 28 on plane 32 to location 30 on plane 33. Consequently, planes 32 and 33 may be viewed as defining the extent of second portion 24.

The feed end 26 of conductive element 20 is connected to the upper end of a center conductor 16*c* associated with coaxial feed 16. Those skilled in the art know that the coaxial feed is often, for convenience, in the form of a coaxial "bulkhead" connector.

Within first portion 22 of winding 12 of FIGS. 1*a* and 1*b,* winding 20 is wound or defined on the "surface" 41 of a section or segment of a cone designated 41*c*. Cone segment 41*c* is centered on axis 8, has its smaller diameter D1 at plane 31, and its larger diameter at plane 32. Within second portion 24 of winding 12 of FIGS. 1*a* and 1*b*, winding 20 is similarly wound or defined on the "surface" 42 of a section or segment of a cone designated 42*c*. Cone segment 42*c* is centered on axis 8, has its smaller diameter D1 at plane 33, and its larger diameter at plane 32. Since the diameters of the cones are identical at plane 32, the diameters of both cones at this plane are equal, and are designated D2.

Those skilled in the art will recognize the antenna of FIGS. 1*a* and 1*b* as being a form of helical antenna, other forms of which may be used in either an circularly-polarized axial mode in some frequency ranges, or as a linear hemispherical-coverage antenna in other frequency ranges. Only the axial mode is of interest for purposes of this invention. It has been discovered that an antenna winding with multiple sections, each having a different taper (cone angle) and with different pitch angles, as described in conjunction with FIGS. 1*a* and 1*b* has advantageous properties for use in an array antenna. More particularly, it has been found that the directive gain of the antenna is greater than would be expected for a correspondingly long straight or uniform-taper helical antenna. As a concomitant of the reduced axial length of the antenna for a given gain, its mutual coupling to adjacent like antenna elements in an array environment is decreased. As a result, the array spacing is less affected by considerations of mutual coupling, allowing more design freedom. The decreased coupling, in turn, tends to reduce the need for a surrounding cup for each element of an array using the antenna element.

Figure 2:
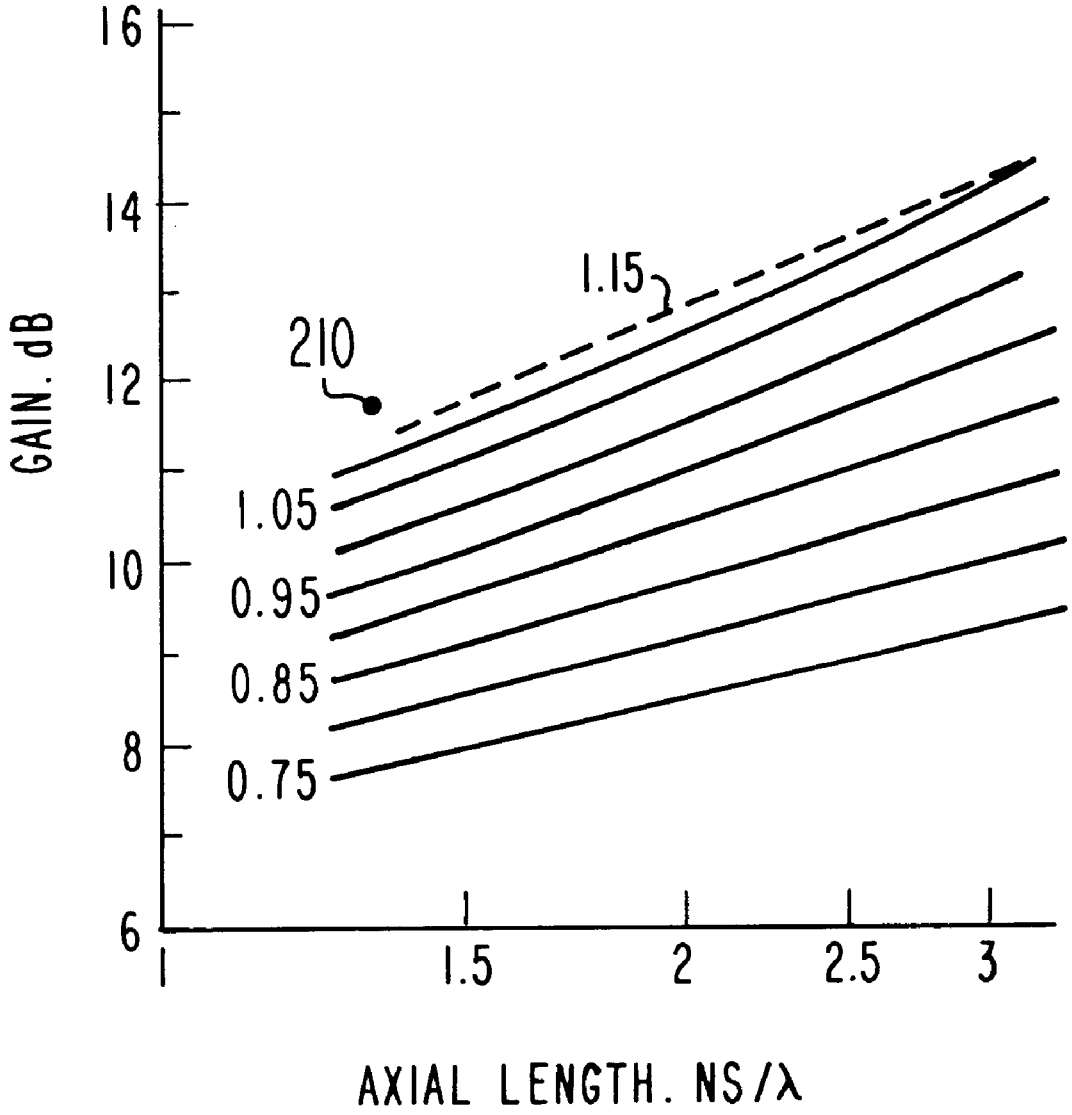
FIG. 2 is a set of plots of gain versus axial length from a text, together with a point representing the directive gain of an axial-mode helical antenna according to an aspect of the invention as in FIGS. 1*a* and 1*b;*

An embodiment of the antenna of FIGS. 1*a* and 1*b* having an axial length of about 0.8λ and a diameter of about 0.2λ had a gain in the range of 11½ to 12 dB. FIG. 2 illustrates parametric gain-versus-axial-length plots as reported in section 13 of Antenna Handbook by Jasik. In FIG. 2, the plots are for a straight, nontapered axial-mode helical antenna with an optimal pitch angle of 12.8°. Each plot is for simplicity designated by its helix circumference in wavelengths: thus plot 1.15 is for a helix having a circumference $\pi D/\lambda$ of 1.15. Other illustrated plots have circumferences of 1.05, 0.95, 0.85, and 0.75. The antenna of FIGS. 1*a* and 1*b*, with an axial length of 0.8λ, falls above all of the plots of FIG. 2, at the location designated 210. Location 210 in FIG. 2 represents a gain which a conventional straight axial-mode helix of the given length and pitch angle cannot achieve. As mentioned above, the gain of the individual elements of an array have a strong effect on the gain of an array taken as a whole, so the relatively high gain of the antenna of FIGS. 1*a* and 1*b* is desirable. As also mentioned above, the relatively short length of the antenna of FIGS. 1*a* and 1*b* for a given gain is advantageous in the context of an array, as it results in reduction of mutual coupling between elements. consequently, not only does the antenna of FIGS. 1*a* and 1*b* have higher gain, but in the context of an array antenna it will tend to maintain its gain more than a conventional axial mode helical antenna, which would be longer for the given gain.

Figure 3:
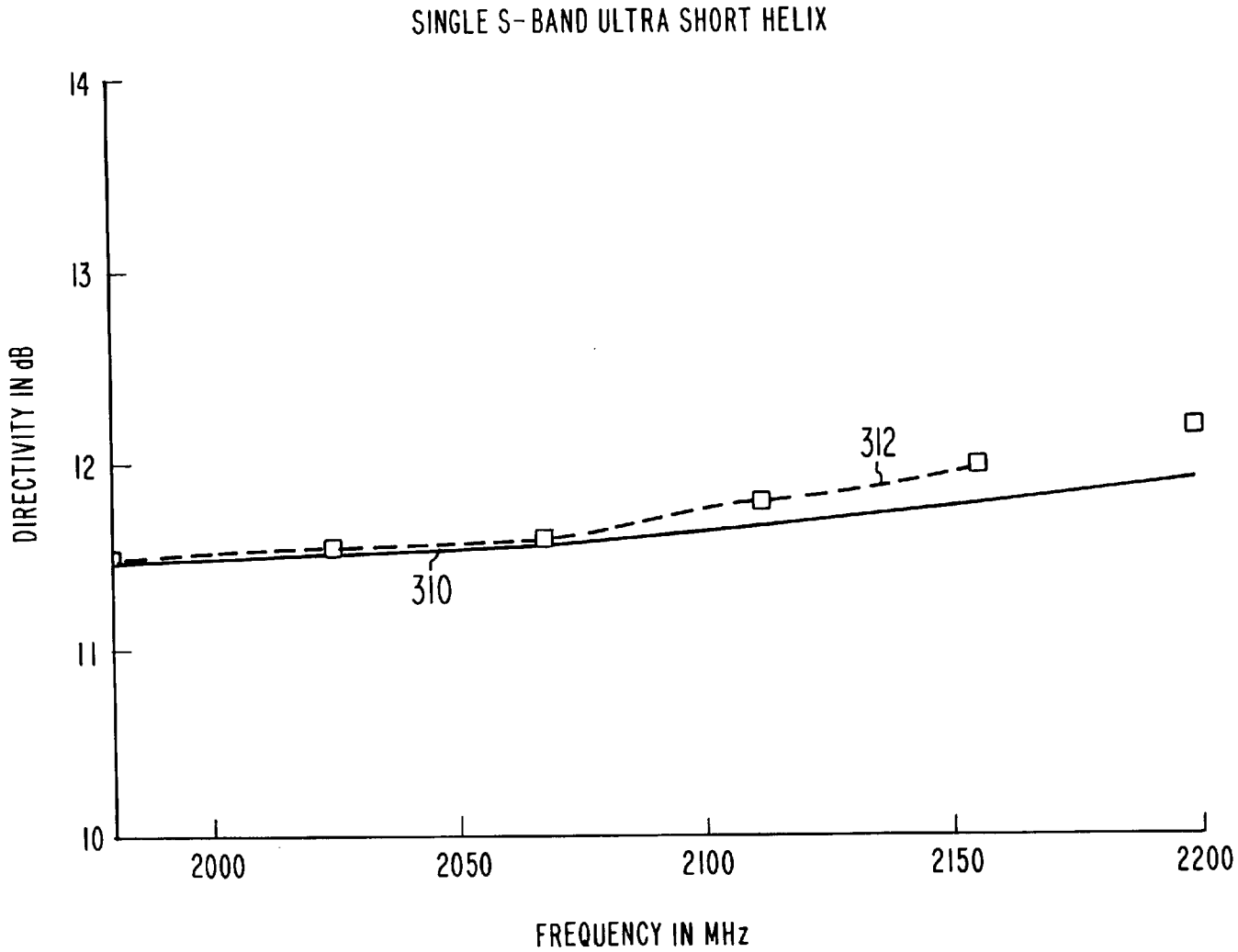
FIG. 3 is a plot of directivity versus frequency for the axial-mode helical antenna of FIGS. 1*a* and 1*b;*
Figure 4:
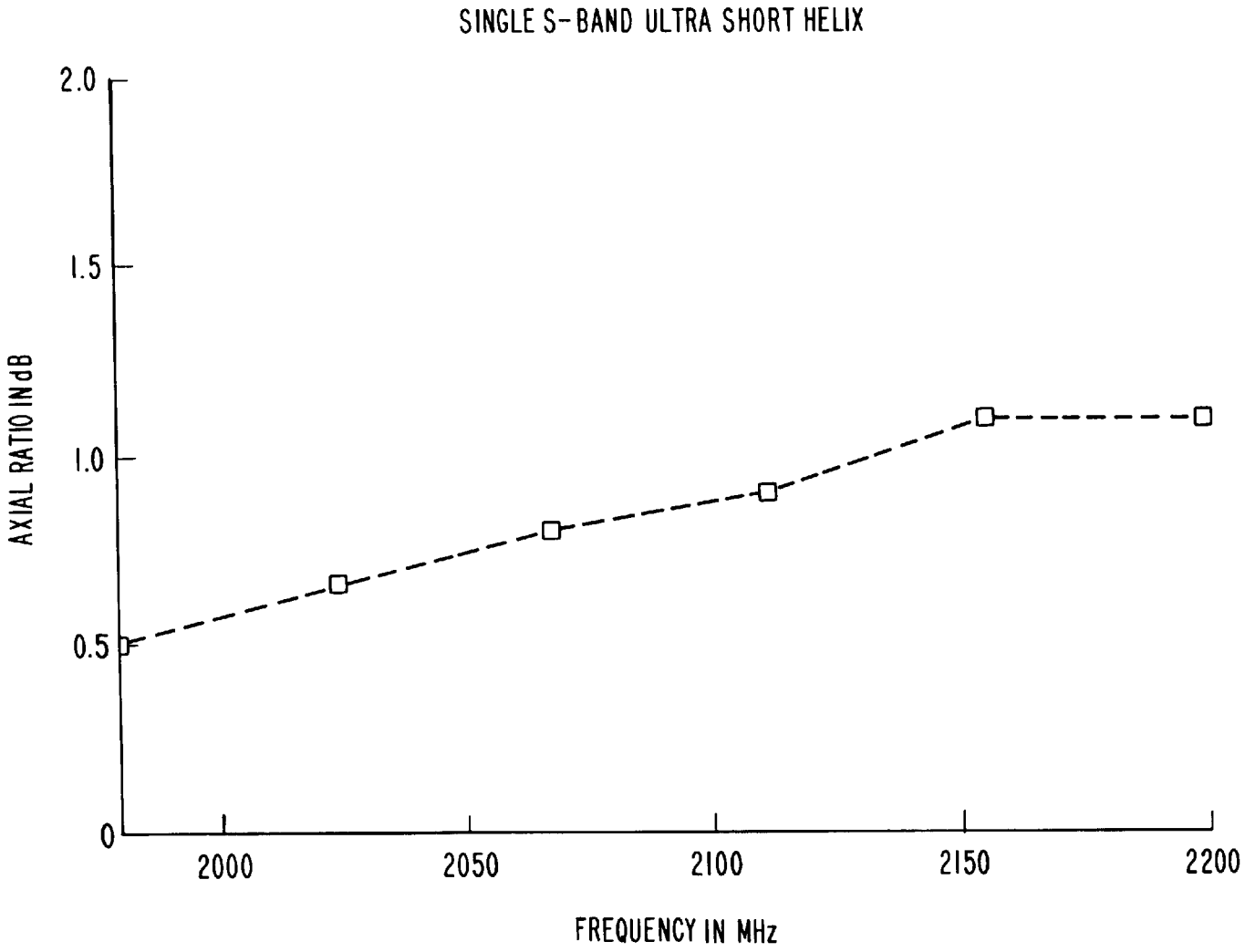
FIG. 4 is a plot of axial ratio in dB versus gain for the antenna of FIGS. 1*a* and 1*b;*
Figure 5:
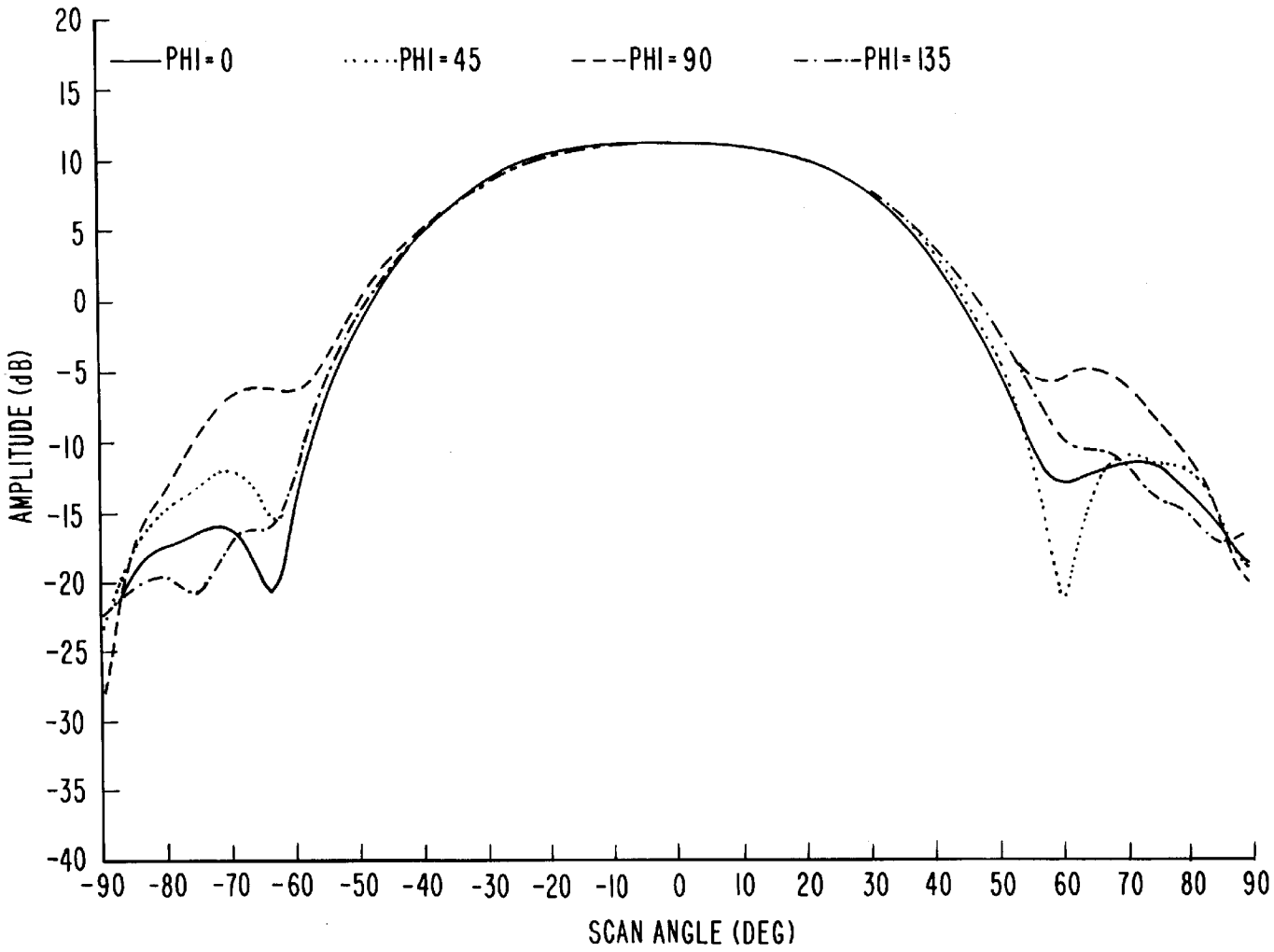
FIG. 5 illustrates plots of the radiation pattern of the antenna of FIGS. 1*a* and 1*b* at 2112 MHz for four different polarization angles.

FIG. 3 illustrates by a solid-line plot 310 the calculated and measured gain, centered at 2100 MHz, of an axial-mode helical antenna according to the invention in which the total axial length is 0.77λ, the axial length of portion 22 is 0.225λ, the axial length of portion 24 is 0.507λ, the diameters D1, D2, and D3 are 0.18λ, 0.356λ, and 0.226λ, respectively, and the ground plane is hexagonal with side measuring 2λ. In this embodiment, the conductor 20 is copper wire having a diameter of 0.01λ. For this antenna, in FIG. 3, a dash line 312 illustrates the measured gain of a single antenna as in FIGS. 1*a* and 1*b*. The plot of FIG. 4 represents measured axial ratio as a function of frequency, with a value of about 0.85 dB at 2100 MHz. The plots of FIG. 5 represent different cross-sections of the beam of an antenna under test in a simulated array. The presence of an array is simulated by a ring of non-driven (passive) antenna elements surrounding the antenna being tested, with each passive element spaced from the antenna under test by 0.8λ.

Figure 6:
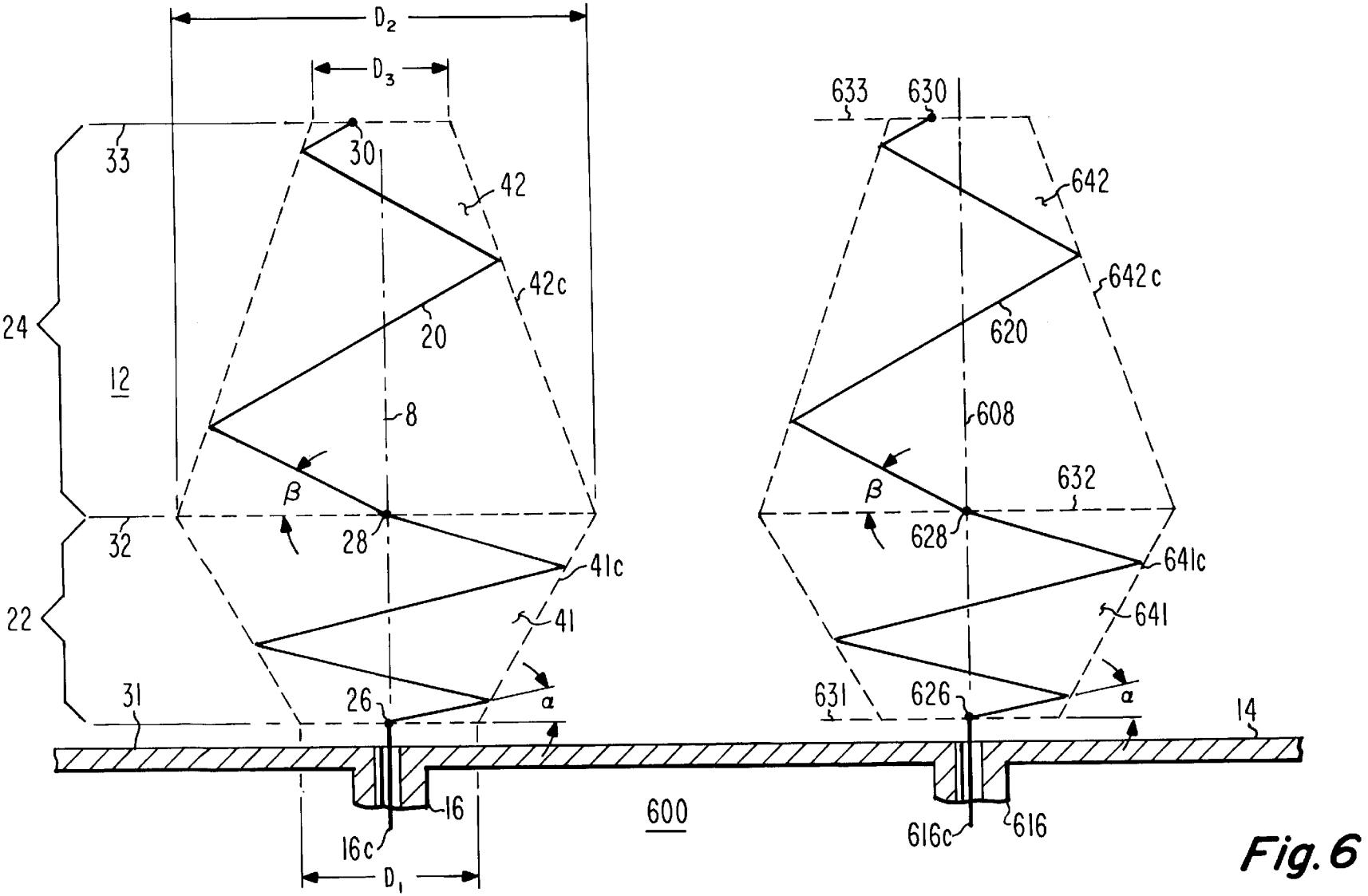
FIG. 6 is an illustration of two antennas similar to that of FIGS. 1*a* and 1*b* mounted on a common ground plane to define an array of axial-mode helices.

FIG. 6 illustrates two antennas such as that of FIGS. 1*a* and 1*b* mounted on a common ground plane to form an array 600. In FIG. 6, the antenna on the left includes reference numerals corresponding to those of the antenna of FIGS 1*a* and 1*b*, while the antenna on the right has like reference numerals in the 600 series.

Figure 7:
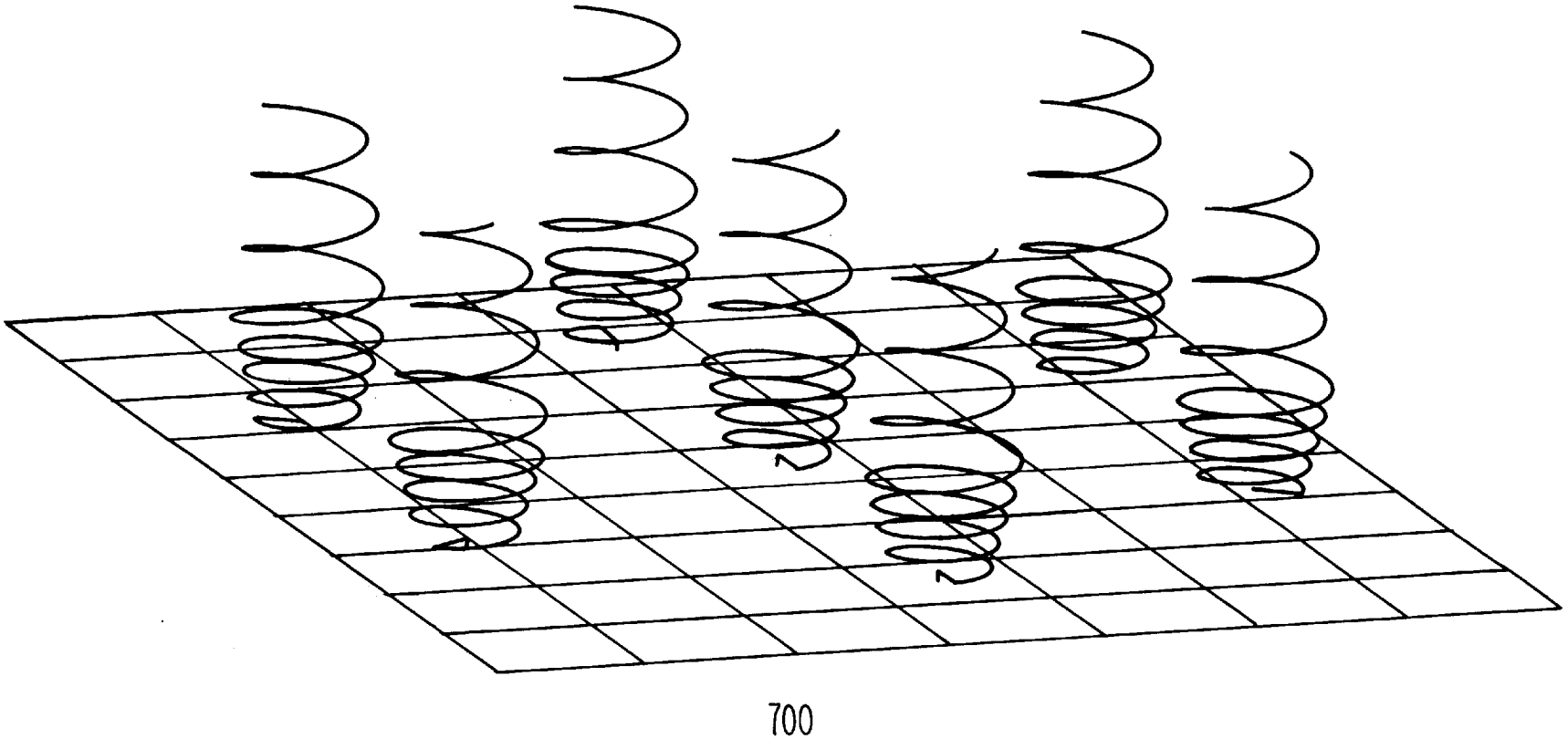
FIG. 7 is a computer-generated illustration of an array antenna including as its elements seven axial-mode helices corresponding to that of FIGS. 1*a* and 1*b*.

FIG. 7 is a computer-generated representation of an array 700 corresponding to that of FIG. 6, but having seven helical elements. The helical elements illustrated in FIG. 7 have various different rotational positions about their axes, to thereby provide improved far-field axial ratio. However, the axial ratios of the helices are quite satisfactory for at least some purposes, and so the various antenna elements of FIG. 7 can also be mounted with identical rotational positioning, if desired.

Other embodiments of the invention will be apparent to those skilled in the art. For example, while the electrical conductor 20 has been described as being free-standing, a dielectric support is preferably used, and has little or no effect on the performance. While all of the described helical antennas have been unifilar, there is no reason that multifilar, including bifilar, antennas could not be made using the winding according to the invention.

Thus, an antenna winding (12) according to an aspect of the invention includes an elongated electrical conductor (20). The elongated electrical conductor (20) includes a feed end (26), and a distal end remote from the feed end (26). The elongated electrical conductor (20) is wound in a generally helical fashion about an axis (8) to define first (22) and second (24) portions of the antenna winding (12). The first portion (22) of the antenna winding (12) has a first diameter (D1) adjacent the feed end (26) of the electrical conductor (20), and a second diameter (D2), different from the first diameter (D1), at an end of the first portion (22) remote from the feed end (26). This first portion (22) of the antenna winding (12) is wound with a first pitch angle (α). Since the electrical conductor (20) is continuous, the second portion (24) of the antenna winding (12) is immediately adjacent the first portion (22) of the antenna winding (12), so the second portion (24) of the antenna winding (12) has the same second diameter (D2) at an end (28) of the second portion (24) which is adjacent the first portion (22), or remote from the distal end (30) of the electrical conductor (20). The second portion (24) of the antenna winding (12) has a third diameter (D3), different from the second diameter (D2), adjacent the distal end (30) of the electrical conductor (20). The second portion (22) of the antenna winding (12) is wound with a second pitch angle (β), different than the first pitch angle (α). The second diameter (D2), which is the diameter at the juncture (28) of the first (22) and second (24) portions of the helical antenna (10), is either greater than the first (D1) and third (D3) diameters or less than the first (D1) and third (D3) diameters. In other words, the second diameter (D2) is one of greater than and less than the first (D1) and third (D3) diameters.

In a particularly advantageous embodiment of the invention, the first (22) and second (24) portions of the antenna (10) are each wound with constant pitch. In this embodiment, the elongated electrical conductor (20) of (or in) the first portion (22) of the antenna winding (12) is wound on the surface of a section or segment of a hypothetical first cone (41) having the first (D1) and second (D2) diameters at its ends. In this embodiment, the elongated electrical conductor (20) in the second portion (24) of the antenna winding (12) is wound on the surface of a section or segment of a second hypothetical cone (42) having the second (D2) and third diameters. The second diameter (D2) is larger than the first (D1) and third (D3) diameters.

According to another aspect of the invention, an antenna array (600, 700) includes a first antenna winding (12) with an elongated electrical conductor (20) including a feed end (26) and a distal end (30) remote from the feed end (26). The elongated electrical conductor (20) is wound in a generally helical fashion about an axis (8) to define first (22) and second (24) portions of the antenna winding (12). The first portion (22) of the antenna winding (12) has a first diameter (D1) adjacent the feed end (26) of the electrical conductor (20), and a second diameter (D2), different from the first diameter (D1), at an end of the first portion (22) remote from the feed end (26). The first portion (22) of the antenna winding (12) is wound with a first pitch angle ($\alpha$). The second portion (24) of the antenna winding (12) has the second diameter (D2) at an end (28, plane 32) of the second portion (24) remote from the distal end (30) of the electrical conductor (20), and a third diameter (D3), different from the second diameter (D2), adjacent the distal end (30) of the electrical conductor (20). The second portion (24) of the antenna winding (12) is wound with a second pitch angle ($\beta$), which is different than the first pitch angle ($\alpha$). The second diameter (D2) is greater than both the first (D1) and third (D3) diameters, or less than both the first (D1) and third (D3) diameters, or in other words the second diameter (D2) is one of greater than and less than the first (D1) and third (D3) diameters. The antenna array (600, 700) includes an electrically conductive ground plane (14) which is oriented orthogonal to the axis (8) about which the first winding (20) is wound, and which is located adjacent the feed end (26) of the elongated electrical conductor (20). A feed (16) is coupled to the ground plane (14) and to the feed end (26) of the elongated electrical conductor (20), for coupling electromagnetic energy to and from the antenna winding (20). In a preferred embodiment of this antenna array (600, 700), the feed (16) is a coaxial feed. This antenna array (600, 700) further includes a second antenna winding (612) different from the first antenna winding (12). The second antenna winding (612) includes a second elongated electrical conductor (620) including a feed end (626) and a distal end (630) remote from the feed end (626), as in the case of the first-mentioned electrical conductor (20). The second elongated electrical conductor (620) is wound in a generally helical fashion about a second axis (608), different from, but parallel to, the first-mentioned axis (8), to define first (622) and second (624) portions of the second antenna winding (612). The first portion (622) of the second antenna winding (612) has the first diameter (D1) adjacent the feed end (626) of the second elongated electrical conductor (620), and the second diameter (D2) at an end of the first portion (622) of the second antenna winding (612) remote from the feed end (626) of the second elongated electrical conductor (620). The first portion (622) of the second antenna winding (612) is wound with the first pitch angle ($\alpha$). The second portion (624) of the second antenna winding (12) has the second diameter (D2) at an end (626, plane 32) of the second portion (624) of the second antenna winding (612) remote from the distal end (630) of the second elongated electrical conductor (620), and the third diameter (D3) adjacent the distal end (630) of the second elongated electrical conductor (620). The second portion (624) of the second antenna winding (612) is wound with the second pitch angle ($\beta$). The second diameter (D2) of the second portion (624) of the second antenna winding (612) is the one of greater than and less than the first (D1) and third (D3) diameters. A second feed (616) is coupled to the ground plane (14) at a location different from the location of the first-mentioned feed (16). The second antenna winding (612) is located with the feed end (626) of the second elongated electrical conductor (620) electrically connected to the second feed (616), to thereby define said array antenna (600) including the first (12) and second (612) antenna windings and the first (16) and second (616) feeds.

What is claimed is:

1. An axial-mode antenna winding, comprising:

an elongated electrical conductor including a feed end and a distal end remote from said feed end, said elongated electrical conductor being wound in a generally helical fashion about an axis to define first and second portions of said antenna winding, said first portion of said antenna winding having a first diameter adjacent said feed end of said electrical conductor, and a second diameter, larger than said first diameter, at an end of said first portion remote from said feed end, said first portion of said antenna winding being wound with a first pitch angle, said second portion of said antenna winding having said second diameter at an end of said second portion remote from said distal end of said electrical conductor, and a third diameter, smaller than said second diameter, adjacent said distal end of said electrical conductor, said second portion of said antenna winding being wound with a second pitch angle, different than said first pitch angle, said first and second portions of said antenna being juxtaposed without an intervening portion which is wound with a constant diameter.

2. A winding according to claim 1, wherein said first and second portions of said antenna are each wound with constant pitch.

3. A winding according to claim 1, wherein said elongated electrical conductor in said first portion of said antenna winding is wound on the surface of a section of a hypothetical cone having said first and second diameters.

4. A winding according to claim 1, wherein said elongated electrical conductor in said second portion of said antenna winding is wound on the surface of a section of a hypothetical cone having said second and third diameters.

5. An axial-mode helical antenna, comprising:

an antenna winding including an elongated electrical conductor including a feed end and a distal end remote from said feed end, said elongated electrical conductor being wound in a generally helical fashion about an axis to define first and second portions of said antenna winding, said first portion of said antenna winding having a first diameter adjacent said feed end of said electrical conductor, and a second diameter, larger than said first diameter, at an end of said first portion remote from said feed end, said first portion of said antenna winding being wound with a first pitch angle, said second portion of said antenna winding having said second diameter at an end of said second portion remote from said distal end of said electrical conductor, and a third diameter, smaller than said second diameter, adjacent said distal end of said electrical conductor, said second portion of said antenna winding being wound with a second pitch angle, different than said first pitch angle, said first and second portions of said helical antenna being juxtaposed without an intervening portion wound with a constant diamete;

an electrically conductive ground plane oriented orthogonal to said axis, and located adjacent said feed end of said elongated electrical conductor; and a feed coupled to said ground plane and to said feed end of said elongated electrical conductor, for coupling electromagnetic energy to and from said antenna.

6. An antenna according to claim 5, wherein said feed is a coaxial feed.

7. An antenna according to claim 6, further comprising:

a second antenna winding different from said first antenna winding, said second antenna winding including a second elongated electrical conductor including a feed end and a distal end remote from said feed end, said second elongated electrical conductor being wound in a generally helical fashion about a second axis, different from, but parallel to, said first-mentioned axis, to define first and second portions of said second antenna winding, said first portion of said second antenna winding having said first diameter adjacent said feed end of said first elongated electrical conductor, and said second diameter at an end of said first portion of said second antenna winding remote from said feed end of said second elongated electrical conductor, said first portion of said second antenna winding being wound with said first pitch angle, said second portion of said second antenna winding having said second diameter at an end of said second portion of said second antenna winding remote from said distal end of said second elongated electrical conductor, and said third diameter adjacent said distal end of said second elongated electrical conductor, said second portion of said antenna winding being wound with said second pitch angle;

a second feed coupled to said ground plane at a location different from said first-mentioned feed; and said second antenna winding being located with said feed end of said second elongated electrical conductor electrically connected to said second feed, to thereby define an array antenna including said first and second antenna windings.

* * * * *